US005673021A

United States Patent [19]

Woods

[11] Patent Number: 5,673,021

[45] Date of Patent: Sep. 30, 1997

[54] MAGNETIC SWITCH ASSEMBLY FOR DETECTING UNAUTHORIZED OPENING OF DOORS OR WINDOWS

[76] Inventor: Randall Woods, 230 Longbranch East, Prescott, Ariz. 86303

[21] Appl. No.: 651,752

[22] Filed: May 22, 1996

[51] Int. Cl.[6] ..... G08B 13/08

[52] U.S. Cl. ..... 340/547; 335/205; 335/207; 335/280; 200/302.3

[58] Field of Search ..... 340/547, 545, 340/542, 686, 687; 200/302.3; 335/207, 230, 205

[56] References Cited

U.S. PATENT DOCUMENTS

| | | | |
|---|---|---|---|
| 1,051,962 | 2/1913 | Lundquist | 116/86 |
| 1,192,893 | 8/1916 | Harvey | 116/88 |
| 1,868,923 | 7/1932 | Semon | 116/88 |
| 3,516,036 | 6/1970 | Lea | 335/207 |
| 3,535,664 | 10/1970 | Staar | 335/153 |
| 3,630,168 | 12/1971 | Findlay | 116/74 |
| 3,650,347 | 3/1972 | Campos | 180/282 |
| 3,763,484 | 10/1973 | Byers | 340/669 |
| 3,774,128 | 11/1973 | Orlando | 340/669 |
| 3,816,680 | 6/1974 | Suzuki et al. | 200/61.51 |
| 3,842,377 | 10/1974 | Barndt | 335/207 |
| 3,863,182 | 1/1975 | Lapointe | 335/207 |
| 4,042,796 | 8/1977 | Zink | 200/61.45 R |
| 4,057,773 | 11/1977 | Cohen | 335/205 |
| 4,062,314 | 12/1977 | Allen et al. | 116/85 |
| 4,168,410 | 9/1979 | Norris | 200/61.45 R |
| 4,209,777 | 6/1980 | Morrison | 340/547 |
| 4,275,391 | 6/1981 | Okamura | 340/571 |
| 4,287,512 | 9/1981 | Combs | 340/542 |
| 4,293,860 | 10/1981 | Iwata | 343/715 |
| 4,326,196 | 4/1982 | Plevy | 340/545 |
| 4,336,518 | 6/1982 | Holce et al. | 335/205 |
| 4,450,326 | 5/1984 | Ledger | 200/61.45 M |
| 4,456,897 | 6/1984 | Holce et al. | 335/205 |
| 4,553,134 | 11/1985 | Holt | 340/545 |
| 4,567,846 | 2/1986 | Kurtz | 116/86 |
| 4,580,062 | 4/1986 | MacLaughlin | 307/113 |
| 4,628,160 | 12/1986 | Canevari | 200/61.45 R |
| 4,656,458 | 4/1987 | Iwata | 340/669 |
| 4,733,324 | 3/1988 | George | 361/118 |
| 4,788,517 | 11/1988 | Meister | 335/205 |
| 4,806,910 | 2/1989 | Salzer | 340/547 |
| 4,945,340 | 7/1990 | Brill | 340/547 |
| 4,982,058 | 1/1991 | Schroeder et al. | 200/61.62 |
| 5,192,839 | 3/1993 | Imade et al. | 200/61.45 R |
| 5,248,861 | 9/1993 | Kato et al. | 200/61.45 M |
| 5,248,959 | 9/1993 | Chern | 340/601 |
| 5,332,992 | 7/1994 | Woods | 340/547 |
| 5,534,849 | 7/1996 | McDonald et al. | 340/517 |
| 5,543,767 | 8/1996 | Elenbaas | 335/205 |

*Primary Examiner*—Jeffery Hofsass
*Assistant Examiner*—Benjamin C. Lee
*Attorney, Agent, or Firm*—Hovey, Williams, Timmons & Collins

[57] ABSTRACT

A magnetic switch assembly (10) for electrically coupling with an electrical circuit of an alarm system detecting relative movement between first and second adjacent members and for defeating attempted magnetic manipulation of the switch assembly (10) is disclosed. The switch assembly (10) includes a ball switch (20) for sensing the presence of an intruder's magnet (28) in the vicinity of the switch assembly (10) and for changing the state of the electrical circuit in response thereto. The switch assembly (10) also includes a reed switch (22) electrically coupled with the ball switch (20) for detecting relative movement between the first and second adjacent members and for changing the state of the electrical circuit in response thereto independently of the ball switch (20).

13 Claims, 2 Drawing Sheets

Fig. 1.
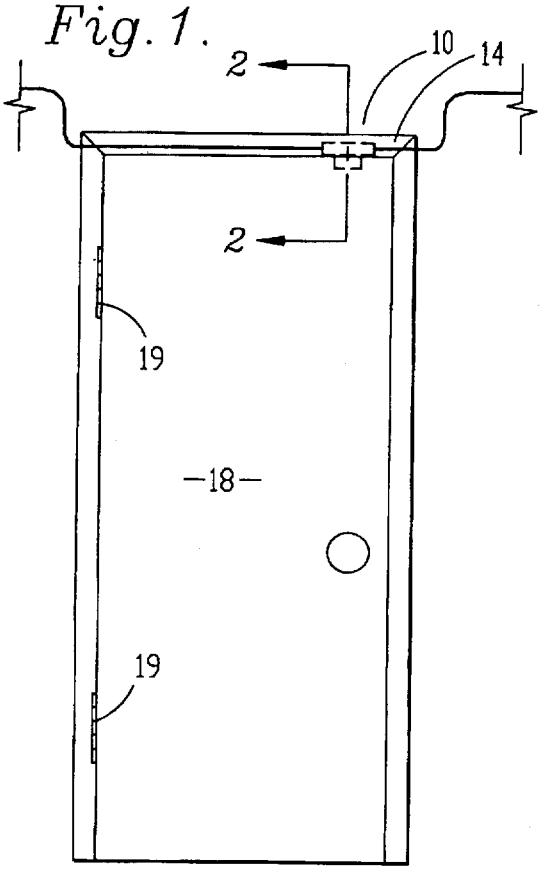
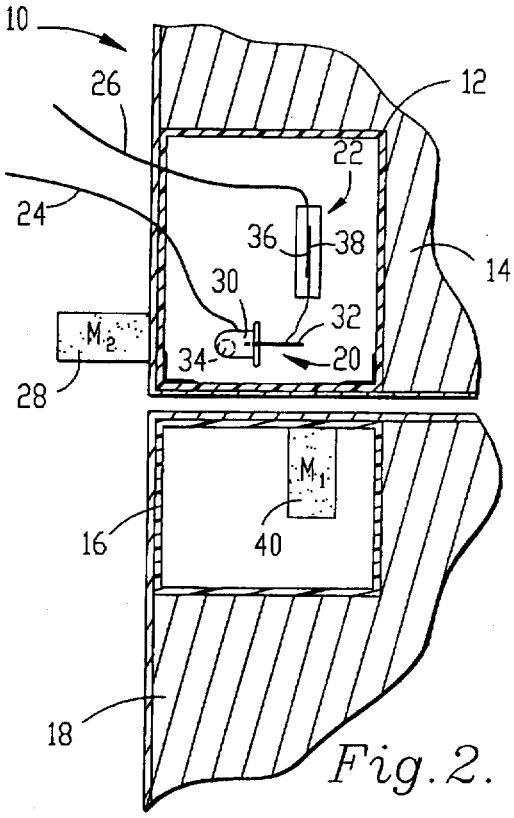
Fig. 2.
Fig. 4.
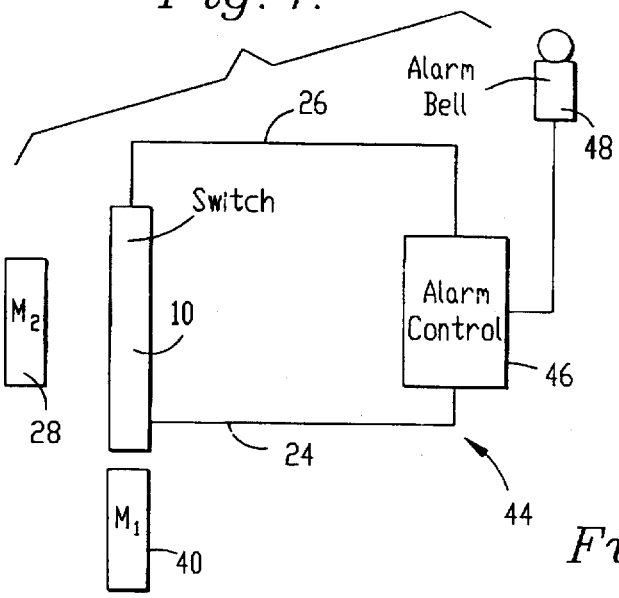
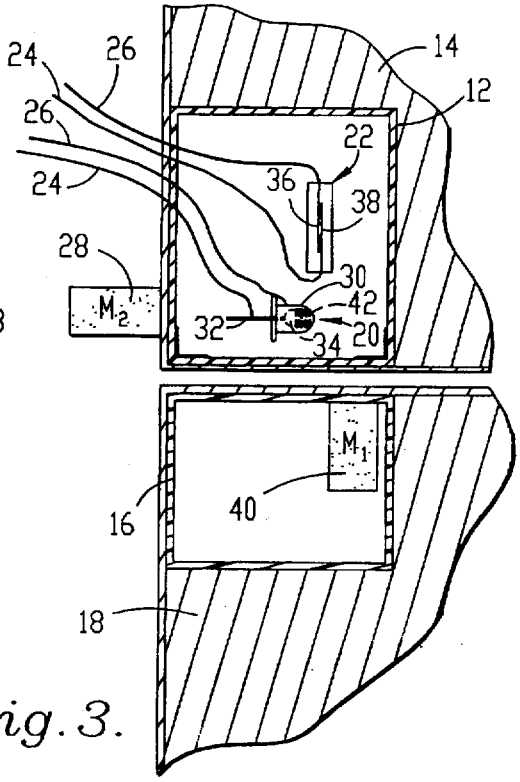
Fig. 3.

MAGNETIC SWITCH ASSEMBLY FOR DETECTING UNAUTHORIZED OPENING OF DOORS OR WINDOWS

BACKGROUND OF THE INVENTION

1. Field of the Invention

The present invention relates to magnetic switch assemblies used with security systems to detect unauthorized entry through doors or windows. More particularly, the present invention relates to an improved magnetic switch assembly that more effectively defeats attempted magnetic manipulation of the switch assembly by an intruder's magnet and that is simple and economical to construct and install.

2. Description of the Prior Art

Magnetic switch assemblies for use with alarm systems are known in the art. For example, one common switch assembly includes a magnetic reed switch mounted in a door or window frame and a magnet carried by the adjacent openable door or window. The magnet carried by the door or window holds the reed switch in its opened or closed position (depending on whether the switch is of the normally opened or normally closed type) when the door or window is closed, and permits the reed switch to switch to its other position when the door or window is opened. The reed switch is typically interposed in an electrical circuit of an alarm system so that upon unauthorized opening of the door or window, the switch operation generates an alarm signal.

One problem with reed-type switch assemblies is that they can be readily defeated by simply placing an external magnet adjacent the door or window frame in proximity to the reed switch. The external magnet holds the reed switch in its normal position and thus allows the door or window to be opened without triggering the alarm.

Improved magnetic switch assemblies have been developed to overcome this limitation of reed-type switches. For example, U.S. Pat. No. 5,332,992, hereby incorporated by reference, discloses a magnetic switch assembly including a ball-type switch that is held in one switch position by a door magnet and that is shifted to the other switch position whenever the door is opened or when an intruder's magnet is placed in the vicinity of the switch assembly. This allows the switch to both detect the opening of a door or window and to prevent magnetic manipulation of the switch by an intruder's magnet.

Although the switch assembly disclosed in the '992 patent defeats attempted magnetic manipulation of alarm systems, it requires a biasing means to bias or push the ball from its normally opened or closed position when the door or window is opened. The biasing action is typically accomplished by forming the switch with a sloped lower surface or by placing a small spring between the ball and one of the switch elements.

Those skilled in the art will appreciate that forming a switch assembly with a sloped lower surface or a spring increases the cost and complexity of the switch assembly and requires more precise alignment of the switch in the door or window frame during installation. Moreover, conventional biasing means occasionally fail to bias the ball off its normally opened or closed position when the door is opened because of arc welds formed between the ball and one or both of the switch elements. Thus, prior art ball-type magnetic switches occasionally fail to detect the opening of the door or window and thus fail to trigger an alarm.

Another limitation of reed-type and ball-type switch assemblies is that neither are designed to prevent magnetic manipulation of an alarm system that occurs when an intruder places a magnet behind the door or window. For example, an intruder can defeat a conventional ball-type switch as well as a reed-type switch by first breaking through the glass on the door or window and then reaching inside the door or window and placing the magnet behind the switch.

OBJECTS AND SUMMARY OF THE INVENTION

In view of the these limitations of prior art magnetic switch assemblies, it is an object of the present invention to provide an improved magnetic switch assembly.

It is a more particular object of the present invention to provide a magnetic switch assembly that detects attempted magnetic manipulation of the switch assembly without requiring the use of a biasing means such as sloped surface or spring to bias the ball away from its normally opened or closed position.

It is another object of the present invention to provide a magnetic switch assembly that more effectively prevents magnetic manipulation of the switch assembly by detecting the presence of an intruder's magnet regardless of where the intruder's magnet is placed relative to the switch assembly.

It is another object of the present invention to provide a magnetic switch assembly that achieves the above objectives while being simple and economical to construct and install.

In view of these objects and other objects that become evident from the following description of the present invention, an improved magnetic switch assembly for electrically coupling with an electrical circuit of an alarm system is provided. The switch assembly both detects relative movement between first and second adjacent members such as a door and a door frame or a window and a window frame and detects attempts to defeat the switch assembly with an external magnet. When the switch assembly detects either of these conditions, it changes the state of the electrical circuit of the alarm system to an alarm state.

In one embodiment of the invention, the switch assembly broadly includes an upper housing adapted for mounting within a first stationary member such as a door or window frame and a mating lower housing adapted for mounting within a second movable member such as a door or window.

The upper housing includes a pair of first and second switches. The first switch is operable for sensing the presence of an intruder's magnet in the vicinity of the switch assembly and for changing the state of the electrical circuit of the alarm system to an alarm state in response thereto. The second switch is electrically coupled with the first switch and is operable for detecting relative movement between the first and second adjacent members and for changing the state of the electrical circuit to an alarm state in response thereto independently of the first switch means. In preferred forms, the first switch includes a ball switch and the second switch includes a reed switch.

The lower housing includes a magnet which exerts a magnetic field in the vicinity of the first and second switches when the door or window is closed. When the door or window is closed, the magnetic field generated by the magnet closes or opens both of the switches. However, if an intruder attempts to apply an external magnet to the frame of the door or window to defeat the operation of the switch assembly, the magnetic field from the intruder's magnet changes the state of the first switch and thus triggers the alarm of the security system. Additionally, when the door is opened, the magnet is moved away from the second switch so that the second switch changes state and triggers the alarm system.

By constructing a switch assembly as described above, numerous advantages are realized. For example, since the second switch detects relative movement between the door and door frame or window and window frame, the first switch need only detect the presence of an intruder's magnet. Thus, the first switch does not require biasing means such as a sloped lower surface or a spring to bias the switch from its normal position when the door or window is opened. In fact, the first switch can remain in its normal position even after the door or window is opened because the second switch will detect the opening of the door or window independently of the first switch. Thus, the switch assembly of the present invention not only prevents magnetic manipulation of an alarm system by an intruder's magnet, it is also simple and economical to construct and install.

In a second embodiment of the invention, the switch assembly is configured for defeating attempted magnetic manipulation of the switch from an intruder's magnet that is placed inside or behind the door or window. The second embodiment of the switch assembly broadly includes an upper housing adapted for mounting within a first stationary member such as a door or window frame and a mating lower housing adapted for mounting within a second movable member such as a door or window.

The upper housing includes at least two switches electrically coupled with an electrical circuit of the alarm system and strategically positioned within the upper housing for detecting the presence of an intruder's magnet no matter where the magnet is placed relative to the switch assembly. When the switch assembly detects an intruder's magnet, it changes the state of the electrical circuit of the alarm system to an alarm state.

The lower housing includes a magnet which exerts a magnetic field in the vicinity of the switches when the door or window is closed. The magnet is strategically oriented so that when the door is closed, its magnetic field normally opens or closes the switches in the upper housing. However, if an intruder attempts to apply an external magnet to a first face of the switch assembly to attempt to defeat the operation of the switch assembly, the first switch changes state to trigger the alarm system. Similarly, if an intruder attempts to apply an external magnet to a second face of the switch assembly different from the first face, the second switch changes state to trigger the alarm system.

By constructing a switch assembly in accordance with this second embodiment of the invention, numerous advantages are realized. For example, since the first and second switches are positioned for detecting an intruder's magnet placed adjacent different sides of the switch assembly, an intruder cannot defeat the switch by simply breaking through the glass on the window or door and placing the magnet inside or behind the switch assembly. This construction also permits the switch housing to be placed on the exterior of the door or window since a switch can be added to the switch housing to detect an intruder's magnet placed on top of the switch assembly.

BRIEF DESCRIPTION OF THE DRAWING FIGURES

FIG. 1 is an elevational view of a hingedly mounted door protected by a switch assembly in accordance with the present invention wherein the switch assembly is illustrated partially in phantom and is shown interposed within an intruder alarm system;

FIG. 2 is an enlarged, fragmentary vertical sectional view taken along line 2—2 of FIG. 1 showing a door-mounted, normally closed switch assembly in accordance with a first embodiment of the invention and also illustrating attempted magnetic manipulation of the switch assembly by an external magnet;

FIG. 3 is a view similar to that of FIG. 2, but illustrating a normally opened switch assembly in accordance with the first embodiment of the invention;

FIG. 4 is a schematic representation of the switch assembly of the present invention shown interposed in a security alarm system;

Figure 5:
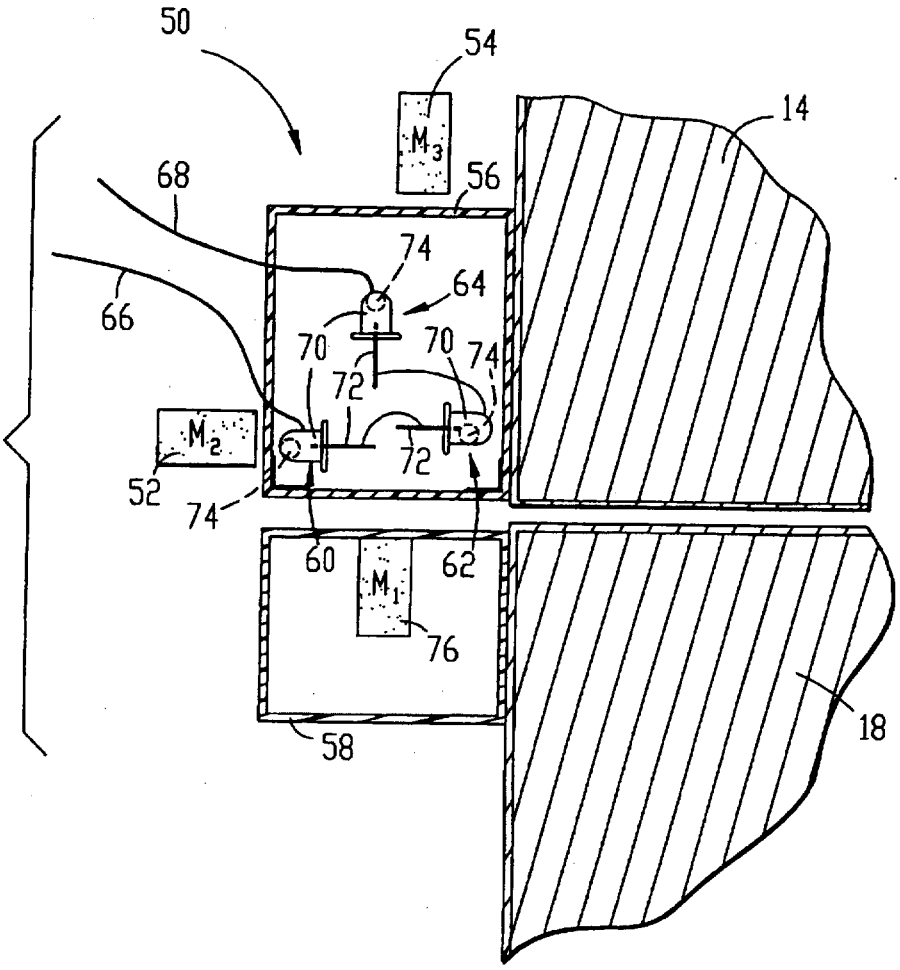
Figure 6:
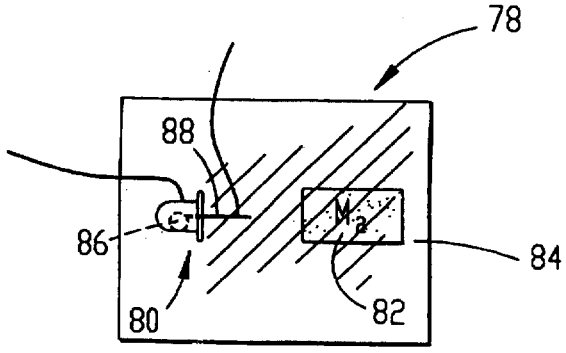

FIG. 5 is an enlarged, fragmentary vertical sectional view showing a door-mounted, normally closed switch assembly in accordance with a second embodiment of the invention and also illustrating attempted magnetic manipulation of the switch assembly by a plurality of external magnets; and FIG. 6 is an elevational view of a glass pane protected by a switch assembly in accordance with a third embodiment of the present invention wherein the switch assembly is shown interposed within an intruder alarm system.

DETAILED DESCRIPTION OF THE PREFERRED EMBODIMENTS

Turning now to the drawings, and particularly FIGS. 1–2, a switch assembly 10 constructed in accordance with a first embodiment of the invention is illustrated. The switch assembly 10 broadly includes an upper housing 12 adapted for mounting within a first stationary member such as a door frame 14 or window frame and a mating lower housing 16 adapted for mounting within a second movable member such as a door 18 or window.

The upper and lower housings 12,16 are preferably formed of synthetic resin materials. As shown in FIG. 1, the door 18 is of the conventional type and is mounted on hinges 19 for movement between closed and opened positions.

Referring specifically to FIG. 2, the upper housing 12 includes a first switch 20 and second switch 22. The first and second switches 20,22 are preferably wired in series. The switch assembly 10 is preferably interposed within an electrical circuit of a conventional alarm system by a pair of electrical leads 24,26. As described in more detail below, the first switch 20 is operable for sensing the presence of an intruder's magnet 28 in the vicinity of the switch assembly 10, and the second switch 22 is operable for detecting relative movement between the door 18 and door frame 14 or window and window frame.

The first switch 20 is preferably a ball-type switch having a metallic, electrically conductive housing 30 and an electrically conductive pin 32 that extends from the base of the housing 30. The housing 30, which acts as a first switch element, is coupled with one of the electrical leads 24, and the pin 32, which acts as a second switch element, is wired in series with the second switch 22.

The ball switch 20 also includes a shiftable, electrically-conductive ball 34 disposed within the housing 30. The ball 34 is movable within the housing 30 between a switch closed position wherein it contacts both the housing 30 and the pin 32 and a switch open position illustrated in FIG. 2 wherein it is spaced from the pin 32.

The ball 34 is preferably formed of ferromagnetic materials so that its motion is influenced by a magnetic field as described below. The housing 30 and pin 32 are preferably constructed of non-magnetic materials so that they do not interfere with the magnetic effect exerted on the ball 34.

The second switch 22 is preferably a reed-type switch having a pair of adjacent reed switch elements 36,38. The reed switch 22 may be configured as a normally opened or normally closed switch and may be either a conventional unbiased reed switch or a biased or balanced reed switch employing a small magnet to influence the switch action of the reed switch elements 36,38. As those skilled in the art will appreciate, the switch elements 36,38 of the reed switch 22 change state when the reed switch 22 is exposed to a magnetic field.

The lower housing 16 includes a magnet 40 that exerts a magnetic field in the vicinity of the first and second switches 20,22 when the door 18 or window is closed. The first and second switches 20,22 are strategically oriented relative to the magnet 40 so that the first switch 20 detects when the intruder's magnet 28 is placed in the vicinity of the switch assembly 10 and the second switch 22 detects relative movement between the door 18 and door frame 14 or window and window frame.

For example, when the door 18 is closed, the magnetic field generated by the magnet 40 normally causes the ball 34 of the first switch 20 to be retained in its switch closed position, i.e., contacting both the housing 30 and the pin 32. However, referring to FIG. 2, if an intruder attempts to defeat the operation of the switch assembly 10 by applying an external magnet 28 near the switch assembly 10, the magnetic field of the intruder's magnet 28 overcomes the magnetic field of the magnet 40, causing the ball 34 to move away from the pin 32. This switches the ball 34 switch to its open position, thus changing the state of the electrical circuit of the alarm system 10 and triggering an alarm.

Similarly, when the door 18 is closed, the magnetic field generated by the magnet 40 causes the reed switch elements 36,38 to move to their closed position. However, when the door 18 is opened and the magnet 40 is moved away from the reed switch 22, the reed switch elements 36,38 shift to their opened position. This also changes the state of the electrical circuit of the alarm system and triggers an alarm.

Since the reed switch 22 detects the relative movement between the door 18 and door frame 14, the ball switch 20 need only detect the presence of an intruder's magnet 28. Thus, there is no need to equip the ball switch 20 with biasing means such as a sloped lower surface or a spring to bias the ball 34 off the pin 32 when the door 18 is opened. In fact, the ball switch 20 may be tilted so that the ball 34 normally rolls by gravity towards the pin 32 so that a smaller magnet may be employed in the lower housing 16.

As illustrated in FIG. 3, the ball switch 20 and reed switch 22 may also be configured to be normally opened when the door 18 is closed. However, this configuration is not preferred because it requires the use of a spring 42 or other biasing mechanism to bias the ball 34 on the pin 32 when the door 18 is opened and necessitates wiring the ball switch 20 and the reed switch 22 in parallel rather than in series.

As shown in FIG. 4, the switch assembly 10 is adapted for mounting within and as a part of an alarm system 44. The alarm system 44 is conventional and includes an alarm control assembly 46 and an alarm bell 48 or other perceptible alarm device. As shown, the electrical leads 24,26 electrically couple the switch assembly 10 within an electrical circuit of the alarm control system 46. Thus, if the alarm system 44 is armed, any opening of door 18 or attempted magnetic manipulation of the switch assembly 10 by an intruder's magnet 28 will close the switch assembly 10 and will trigger an alarm signal.

FIG. 5 illustrates a switch assembly 50 constructed in accordance with a second preferred embodiment of the invention. The switch assembly 50 is configured for defeating attempted magnetic manipulation of the switch 50 from intruder's magnets 52,54 that are placed anywhere near the switch assembly 50, including inside or behind the door 18 or window.

The switch assembly 50 broadly includes an upper housing 56 adapted for mounting on or within a first stationary member such as the door frame 14 illustrated in FIG. 1 and a mating lower housing 58 adapted for mounting on or within a second movable member such as the door 18 or window.

The upper housing 56 preferably includes first, second, and third switches 60,62,64 electrically coupled in series with an electrical circuit of the alarm system 44 by a pair of electrical leads 66,68. As described in more detail below, the switches 60,62,64 are strategically positioned within the upper housing 56 for detecting the presence of intruder's magnets 52,54 no matter where the magnets 52,54 are placed relative to the switch assembly 50.

Each switch 60,62,64 is preferably a ball-type switch having an electrically conductive housing 70, an electrically conductive pin 72 that extends from the base of the housing 70, and a shiftable, ferromagnetic ball 74 disposed within the housing 70. Those skilled in the art will appreciate that the switches 60,62,64 may also be other conventional magnetic type switches such as reed switches.

The lower housing 58 includes a magnet 76 which exerts a magnetic field in the vicinity of the switches 60,62,64 when the door 18 or window is closed. The magnet is strategically oriented so that when the door 18 is closed, its magnetic field normally causes the ferromagnetic balls 74 of all of the three switches 60,62,64 to shift to their closed positions, i.e., contacting both their respective housings 70 and pins 72.

However, if an intruder attempts to defeat the operation of the switch assembly 50 by applying an external magnet 52 to the front face of the switch assembly 50, the ferromagnetic ball 74 of the first switch 60 is moved away from its pin 72, thus changing the state of the electrical circuit of the alarm system 44 and triggering an alarm. Similarly, if an intruder applies an external magnet 54 to the top face of the switch assembly 50 or to the inside of the door 18 or door frame, the ferromagnetic balls 74 of the second and third switches 62,64 move away from their respective pins 72.

With this construction, no matter where an intruder places an external magnet 52,54 adjacent the switch assembly 50, at least one of the switches 60,62,64 will open and cause the alarm system 44 to trigger an alarm. Thus, an intruder cannot defeat the switch assembly 50 by simply breaking through the glass on the window or door 18 and placing a magnet 52,54 inside or behind the switch assembly 50. This construction also permits the upper and lower switch housing 56,58 to be placed on the exterior of the door 18 or window as illustrated since the switch 64 detects an intruder's magnet 52,54 placed on top of the switch assembly 50.

The second embodiment of the invention may also include additional switches disposed at different angles within the upper housing 56 for detecting intruder's magnets 52,54 placed on other sides of the switch assembly 50. Additionally, the switch assembly 50 may be coupled with a reed-type switch to detect relative movement between the door 18 and door frame 14 or window and window frame as described in the first embodiment of the invention.

FIG. 6 illustrates a switch assembly 78 constructed in accordance with a third embodiment of the invention wherein the switch assembly 78 is used as a shock sensor for detecting the breaking of the glass in a window or door 18. In this embodiment, a ball switch 80 and an associated magnet 82 are placed within a glass pane 84. The magnet 76 is placed relative to the ball switch 80 so that it normally holds the ball switch 80 in its closed position. However, whenever the glass 84 is broken or otherwise subjected to a shock, the energy from the shock momentarily shifts the ball 86 away from the pin 88. This shifts the ball switch 80 to its opened position, thus triggering an alarm in the alarm system 44.

Although the invention has been described with reference to the preferred embodiment illustrated in the attached drawing figures, it is noted that equivalents may be employed and substitutions made herein without departing from the scope of the invention as recited in the claims.

Having thus described the preferred embodiment of the invention, what is claimed as new and desired to be protected by Letters Patent includes the following:

1. A switch assembly for electrically coupling with an electrical circuit of an alarm system for detecting relative movement between first and second adjacent members and for defeating attempted magnetic manipulation of the switch assembly by an intruder's magnet, the switch assembly comprising:

first switch means for sensing the presence of the intruder's magnet in the vicinity of the switch assembly and for changing the state of the electrical circuit to an alarm state in response thereto; and second switch means electrically coupled with said first switch means for detecting relative movement between the first and second adjacent members and for changing the state of the electrical circuit to the alarm state in response thereto independently of the first switch means:

wherein the first switch means including:

a ball switch for mounting on the first member, the ball switch including a pair of spaced-apart switch elements and a shiftable, ferromagnetic body disposed between said switch elements and movable between a switch closed position wherein the ferromagnetic body contacts both of the switch elements and a switch open position wherein the ferromagnetic body is moved from one of the switch elements, and a magnet for mounting on the second member and oriented for retaining the ferromagnetic body in one of the switch closed and switch open positions when the members are in one relative position and for permitting shifting of the ferromagnetic body to the other of the switch closed and open positions when the intruder's magnet is placed in the vicinity, of the switch assembly.

2. The switch assembly of claim 1, the ferromagnetic body comprising a ball.

3. The switch assembly as set forth in claim 1, the second switch means including a reed switch for mounting on the first member, the magnet being oriented for retaining the reed switch in one of its open and closed positions when the members are in one relative position and for permitting shifting of the reed switch to the other of its open and closed positions when the members are moved to a second relative position.

4. The switch assembly of claim 1, the switch assembly being a door switch for a hingedly mounted door having a circumscribing door frame, the ball switch and the reed switch being for mounting within the door frame and the magnet being for mounting in the door and movable therewith.

5. A switch assembly for electrically coupling with an electrical circuit of an alarm system for detecting relative movement between first and second adjacent members and for defeating attempted magnetic manipulation of the switch assembly by an intruder's magnet positioned on any side of the switch assembly, the switch assembly comprising:

a magnet for mounting on the second member; and switch means for mounting on the first member for sensing the presence of the intruder's magnet in the vicinity of the switch assembly, the switch means including:

a first switch positioned relative to the mounted magnet so that the mounted magnet retains the first switch in one of its switch closed and switch open positions when the members are in one relative position; and for permitting shifting of the first switch to the other of its switch closed and open positions when the intruder's magnet is placed on a first side of the switch assembly and also when the members are in another relative position, and a second switch positioned relative to the mounted magnet so that the mounted magnet retains the second switch in one of its switch closed and switch open positions when the members are in one relative position; and for permitting shifting of the second switch to the other of its switch closed and open positions when the intruder's magnet is placed on a second side of the switch assembly and also when the members are in another relative position.

6. The switch assembly of claim 5, the switch assembly being a door switch for a hingedly mounted door having a circumscribing door frame, the switch means being for mounting within the door frame and the magnet being for mounting in the door and movable therewith.

7. The switch assembly as set forth in claim 5, further including a third switch positioned relative to the magnet so that the magnet retains the third switch in one of its switch closed and switch open positions when the members are in one relative position and for permitting shifting of the third switch to the other of its switch closed and open positions when the intruder's magnet is placed on a third side of the switch assembly.

8. The switch assembly as set forth in claim 7, the first, second and third switches each comprising a reed switch.

9. The switch assembly as set forth in claim 7, the switch means including a housing for mounting the first, second and third switches on the second member.

10. The switch assembly as set forth in claim 9, the housing being mounted on the exterior of the second member, the first side of the switch assembly being a front face of the housing, the second side of the switch assembly bing a top face of the housing, and the third side of the switch assembly being a rear face of the housing.

11. The switch assembly as set forth in claim 7, the first, second and third switches each comprising a ball switch including a pair of spaced-apart switch elements and a shiftable, ferromagnetic body disposed between the switch elements, the ferromagnetic body being movable between a switch closing direction wherein the ferromagnetic body contacts both of the switch elements and a switch opening direction wherein the ferromagnetic body is moved from one of the switch elements.

12. The switch assembly as set forth in claim 11, the switch closing direction of the ferromagnetic body of the first ball switch being opposed to the switch closing direction of the ferromagnetic body of the second ball switch.

13. The switch assembly as set forth in claim 12, the switch closing direction of the ferromagnetic body of the third ball switch being generally transverse to the switch closing directions of the ferromagnetic bodies of the first and second ball switches.

* * * * *